US008832868B2

(12) United States Patent
Owen

(10) Patent No.: US 8,832,868 B2
(45) Date of Patent: Sep. 16, 2014

(54) GARMENT WITH ATTACHED FLAGS

(75) Inventor: Doug Owen, Morrisville, VT (US)

(73) Assignee: Doug Owen, Morrisville, VT (US)

( * ) Notice: Subject to any disclaimer, the term of this patent is extended or adjusted under 35 U.S.C. 154(b) by 219 days.

(21) Appl. No.: 13/438,414

(22) Filed: Apr. 3, 2012

(65) Prior Publication Data

US 2013/0254975 A1 Oct. 3, 2013

Related U.S. Application Data

(60) Provisional application No. 61/471,244, filed on Apr. 4, 2011.

(51) Int. Cl.
*A41B 15/02* (2006.01)

(52) U.S. Cl.
USPC ..... 2/279; 2/249; 2/244

(58) Field of Classification Search
CPC ..... A41D 27/08; A41D 13/05; A41D 19/00; A41D 19/0024; A41D 19/0037; A41D 19/0051; A41B 15/00; G09F 21/02; G09F 17/00; A42B 1/24; A42B 3/18
USPC ..... 2/279, 69, 244, 249, 93, 102, 77, 243.1
See application file for complete search history.

(56) References Cited

U.S. PATENT DOCUMENTS

| | | | | | |
|---|---|---|---|---|---|
| 1,670,176 | A * | 5/1928 | Woolery | 116/35 R |
| 2,223,029 | A * | 11/1940 | Dunton | 2/160 |
| 2,534,313 | A * | 12/1950 | Starkey | 116/200 |
| 4,850,052 | A * | 7/1989 | Matthews | 2/160 |
| 5,400,437 | A | 3/1995 | Koutras | |
| 5,636,385 | A | 6/1997 | Harrison | |
| 5,671,480 | A | 9/1997 | Krout et al. | |
| 5,734,990 | A * | 4/1998 | Waring | 2/69 |
| 5,819,315 | A | 10/1998 | Ruffa | |
| 5,953,757 | A | 9/1999 | Blanks | |
| 6,085,353 | A | 7/2000 | van der Sleesen | |
| 6,263,510 | B1 | 7/2001 | Bay et al. | |
| 7,520,074 | B1 * | 4/2009 | Vanova | 40/586 |
| 7,743,725 | B2 * | 6/2010 | Kengerski | 116/173 |
| 8,191,172 | B2 * | 6/2012 | Polanish | 2/59 |
| 2004/0255359 | A1 * | 12/2004 | Bordeaux | 2/69 |
| 2006/0021117 | A1 * | 2/2006 | Madonia | 2/422 |
| 2007/0294806 | A1 * | 12/2007 | Harazi | 2/244 |

* cited by examiner

*Primary Examiner* — Khoa Huynh
*Assistant Examiner* — Andrew W Collins
(74) *Attorney, Agent, or Firm* — Woodard, Emhardt, Moriarty, McNett & Henry LLP

(57) ABSTRACT

Among other things, there is disclosed embodiments of garments usable when riding open vehicles such as motorcycles, bicycles or mopeds. One or more pockets are provided in the garment, with a flag attached in each respective pocket. When the user is riding, the flag(s) can be extended from the pocket (s) to wave behind the rider. When the rider desires, the flag(s) can be folded, rolled or otherwise stored or protected within the pocket(s).

17 Claims, 6 Drawing Sheets

GARMENT WITH ATTACHED FLAGS

This application claims the benefits of U.S. Provisional Application No. 61/471,244 filed Apr. 4, 2011, which is hereby incorporated by reference.

The present disclosure concerns garments used when riding a motorcycle or other open mode of transportation, with which the user wishes to demonstrate a flying design, symbol, signal, decoration or other insignia.

BACKGROUND

It is known to place a flag, pennant or similar insignia on one's automobile. Car flags may indicated an individual's interest in or allegiance to a team, university, country, or organization, or for providing other messages or indications to others. An individual displays a particular flag choice, commonly made of high-strength material (e.g. polyester) and are attached to a vehicle via a rigid pole (e.g. plastic or metal) and clip window attachment. As the automobile moves along, with the flag extending from a window or door frame above the roof of the car, passing air causes the flag to wave or flap back and forth. In that situation, essentially the entire extent of the printed area of the flag is stretched and observable to passers-by or others. The motion of the flag has a negligible effect on the car due to the car's size and enclosed nature. However, such an item can cause damage to an automobile window or frame, or can limit the use of a window with which it is used. Further, a rod extending upward from the roof of a car is subject to damage from external sources (e.g. car washes) and such damage can limit the life of the device or render it unusable.

Such flags available for use with automobiles are generally not usable with respect to motorcycles, bicycles, mopeds or similar open modes of transportation, as there are no windows or frames as in an automobile to support them. In the past, flags have been attached to long and relatively thin rods or poles that are attached to the rear frame or fender of a motorcycle, so that the flag extends above and/or behind the head of the rider. When the motorcycle is ridden, the flag waves with the passing air. However, friction from the passing air on the flag and rod generates a force on the rod, stressing or bending it backward relative to the motorcycle. Such forces can exceed the stress limit of the rod, or over time weaken the rod, so that it is permanently bent or broken off. Riders have also considered such rods or flags attached to motorcycle frames to take away from the style or flow of the motorcycle. Further, given the open nature of the mode of transportation, the risk of damage from other outside items or forces is also a risk to the rod or pole.

Motorcycle riders, like others, like to show their allegiances or other preferences as they ride, but generally do not have area on their vehicle for bumper stickers, car flags as discussed above, or similar items. There remains a need for products that will allow the motorcyclist, bicyclist, or similar rider or others to easily demonstrate such tastes without having to find somewhere on the vehicle to attach it and to risk damage to it or to the vehicle itself

SUMMARY

Among other things, there is disclosed a garment for the human body, which may be used in riding an open vehicle such as a motorcycle, bicycle or moped, that includes at least one pocket having an opening and defining an internal space within the garment, and a flag having a base and a free portion extending from the base. The base is attached to the pocket within the internal space so that all of the base is within the internal space and so that at least part of the free portion can extend outside of the opening. The base has a length that is less than a length of the opening. The flag has a first relative position in which the entirety of the flag resides in the internal space, and a second relative position in which at least part of the free portion extends outside of the internal space, and in the second relative position the flag can wave with air passing by while being fixed to the pocket.

In particular embodiments, such a garment may be for the torso of a human body, for example one of a jacket, vest and/or shirt. Those embodiments may have an area that allows a user's arms to extend through the garment, and the pocket(s) are below and/or not anterior (i.e. not further toward the front of the body) of that area. A garment may have a right side and a left side, with a first pocket on the right side and a second pocket on the left side, each pocket having a respective flag attached to it. In some embodiments the flag(s) are attached to the pocket(s) by permanent attachment, which may include at least one of sewing and adhesive attachment, and in others the flag(s) are attached to the pocket(s) by releasable attachment, which may include at least one fastener from the group consisting of snaps, zipper, hook-and-loop fastener, and buttons. The pocket(s) may be built into the garment when the garment is built, or may be initially separate from the garment and attached to an exterior portion of the garment.

Also disclosed are garments that include a portion for covering a user's torso and having right and left areas for allowing the user's arms to pass through, with those areas having at least one of openings or sleeves. First and second pockets are provided, with the first pocket positioned below and not anterior of the right garment area and the second pocket positioned below and not anterior of the left garment area, so that the pockets are away from the user's arms when the arms are extended in front of the user. A first flag is attached within the first pocket, and includes a base entirely within the first pocket and a free portion, with the free portion of the first flag adapted to be able to be contained within the first pocket in a first condition and to be extended outside of the first pocket in a second condition. A second flag is attached within the second pocket, and it includes a base entirely within the second pocket and a free portion. The free portion of the second flag is adapted to be able to be contained within the second pocket in a first condition and to be extended outside of the second pocket in a second condition. When one or both flags are in that second condition and the user is riding an open vehicle, such flag(s) wave behind the user.

In particular embodiments, the base of at least one of the flags is attached to its respective pocket by a permanent attachment, and in others such a base of at least one flag is attached to its respective pocket by a temporary attachment. Kits or products having at least one replacement flag may be provided, so that a temporary attachment of the base of one flag can be discontinued, that flag can be removed from its respective pocket, and a replacement flag can be attached to that respective pocket by a temporary attachment. Such garments may be a jacket, vest and/or shirt, particularly one suitable for use in riding a motorcycle. Pockets in any embodiments may be accessible through openings in garment panels, or between panels (i.e. through seams). These and other embodiments will be evident from the text and drawings herein.

Figure 1:
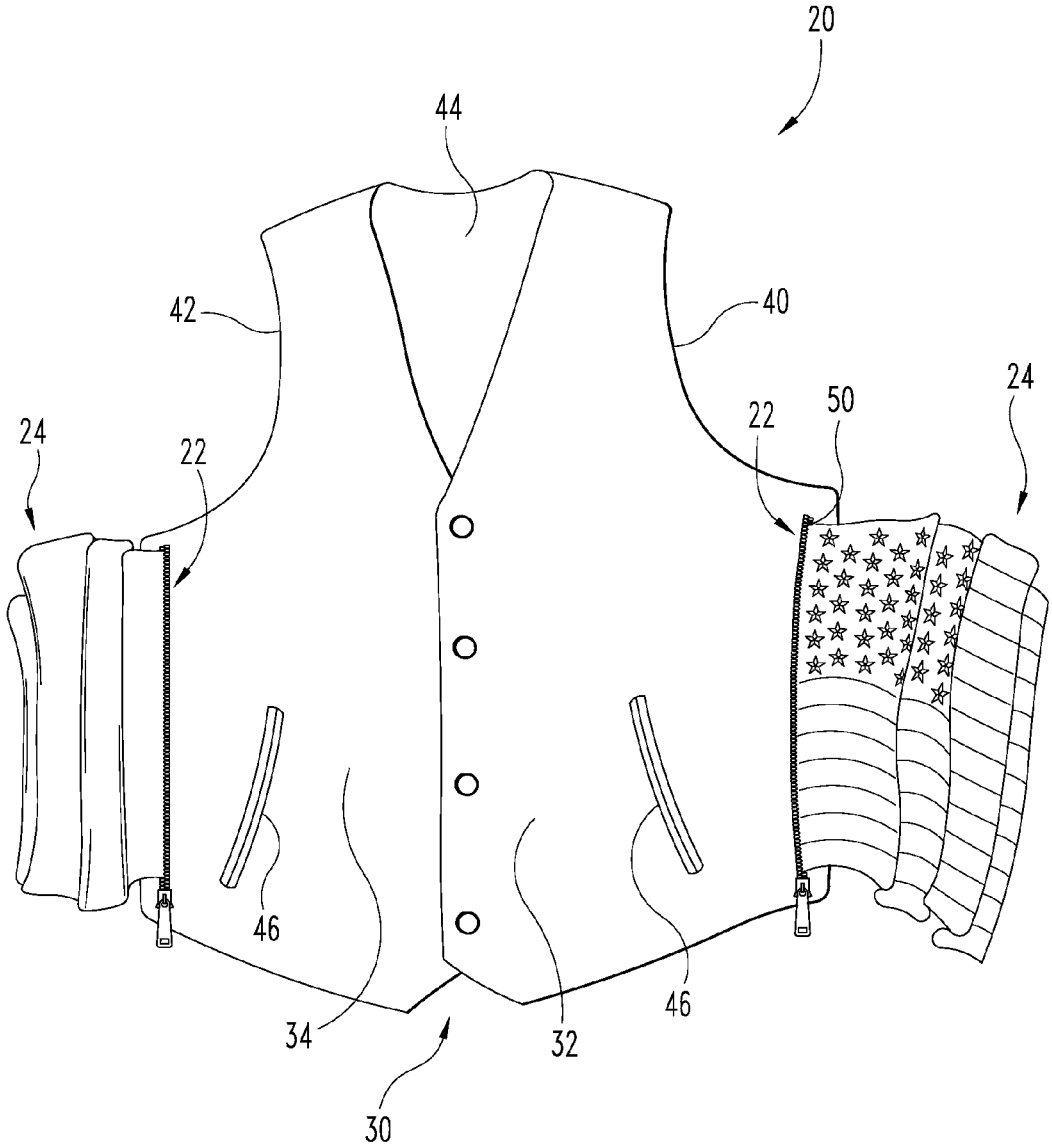
FIG. 1 is a front view of an embodiment of a garment according to the present disclosure.
Figure 2:
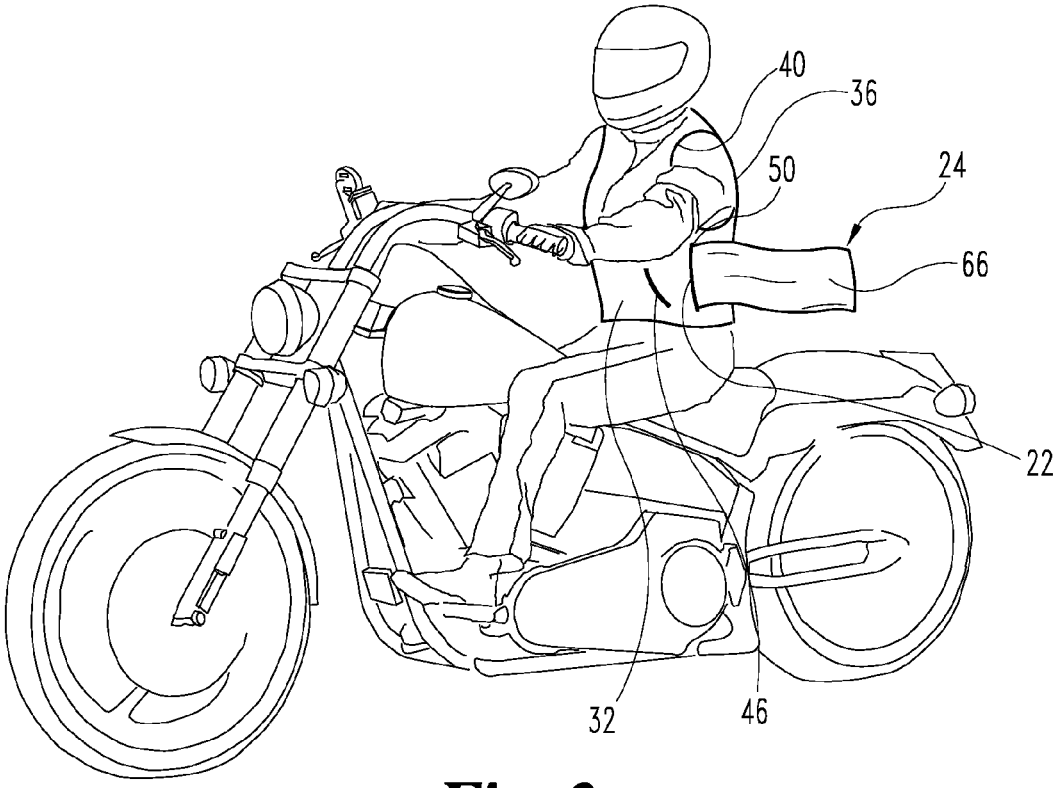
FIG. 2 is a side view of the embodiment of FIG. 1 in use with a representation of a motorcycle and rider.
Figure 3:
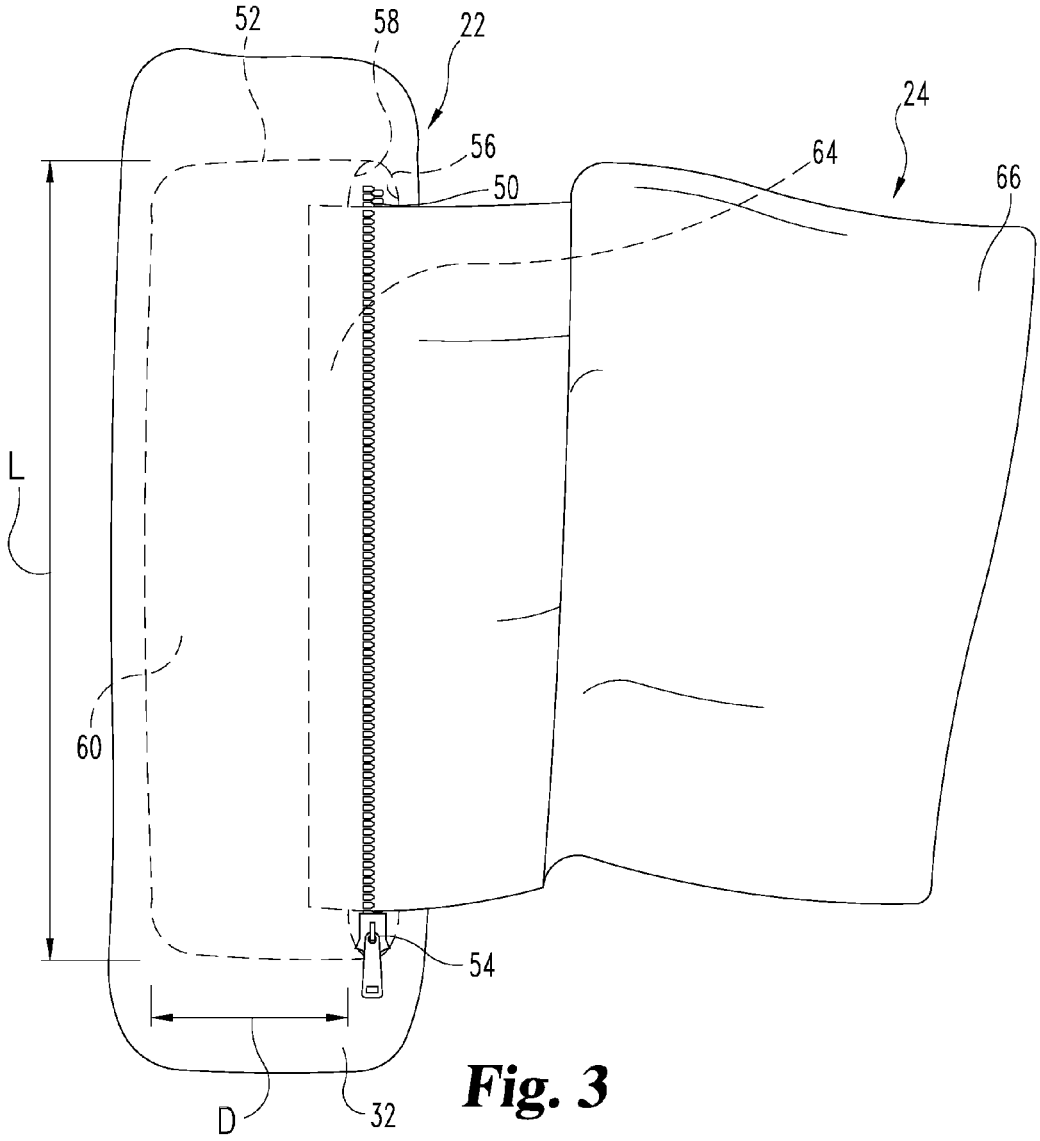
FIG. 3 is a front view of a portion of the embodiment shown in FIG. 1, indicated by A in FIG. 1, in a first condition.
Figure 4:
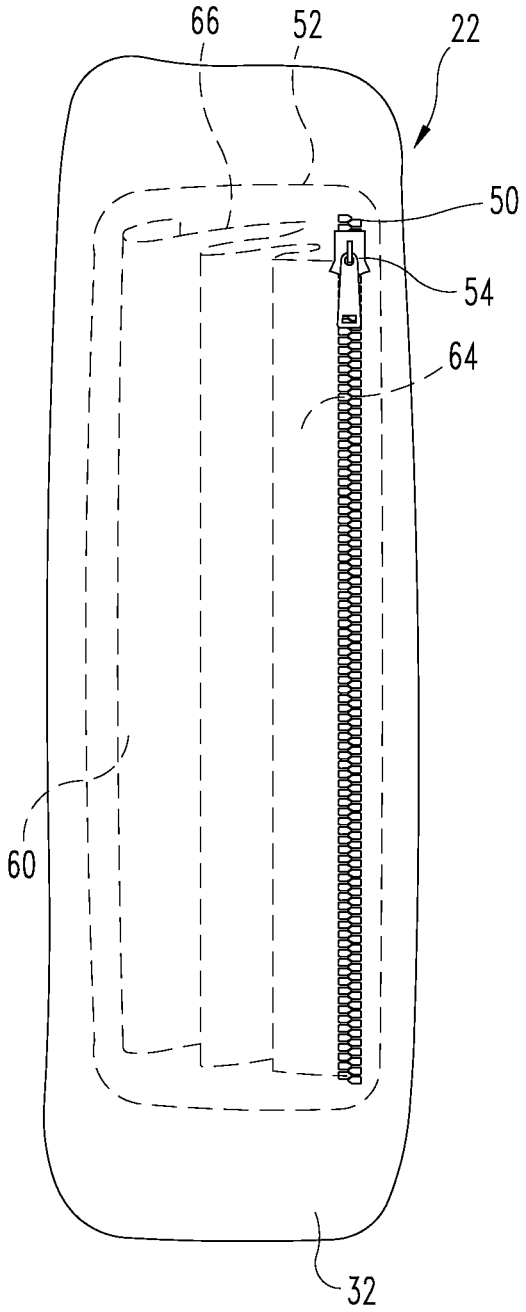

FIG. is a front view of a portion of the embodiment shown in FIG. 1, indicated by A in FIG. 1, in a second condition.

Figure 5:
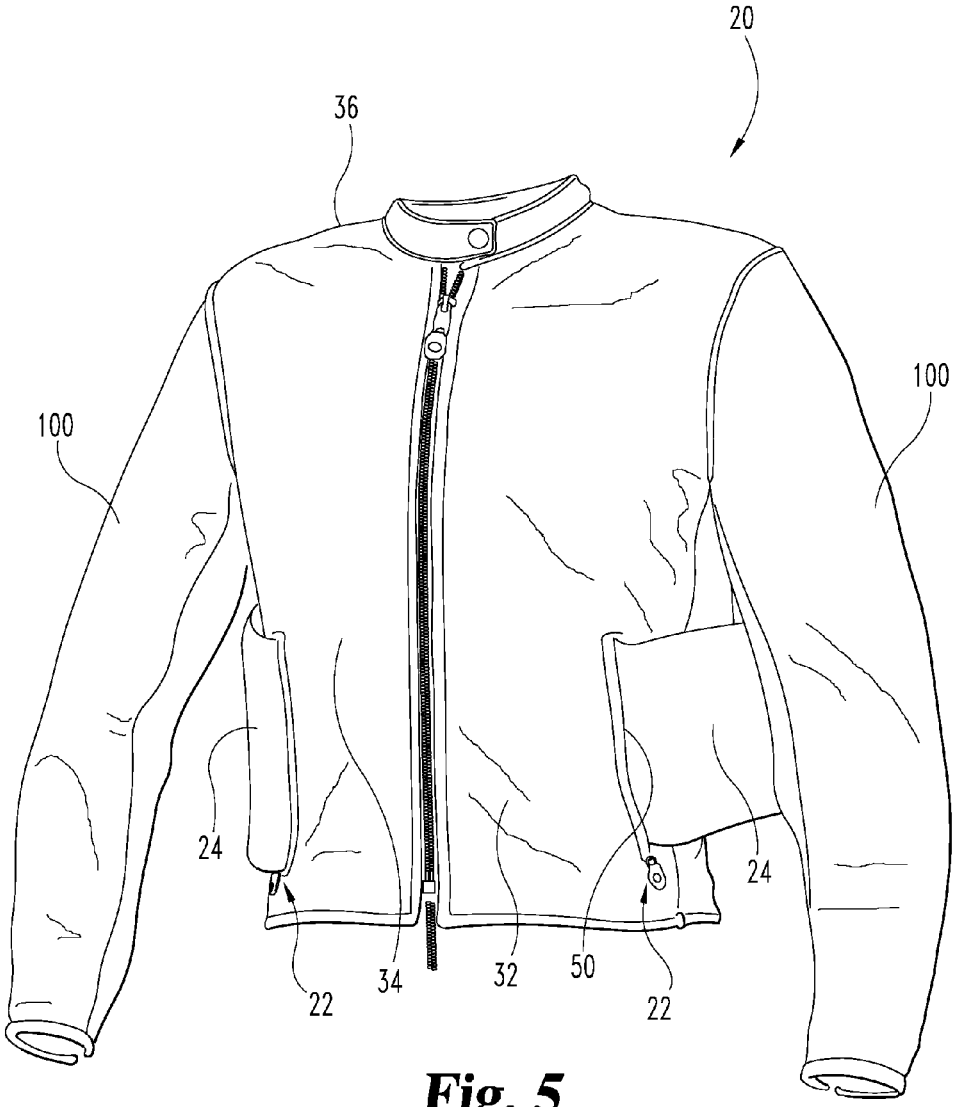

FIG. 5 is a perspective view of an embodiment of a garment according to the present disclosure.

Figure 6:
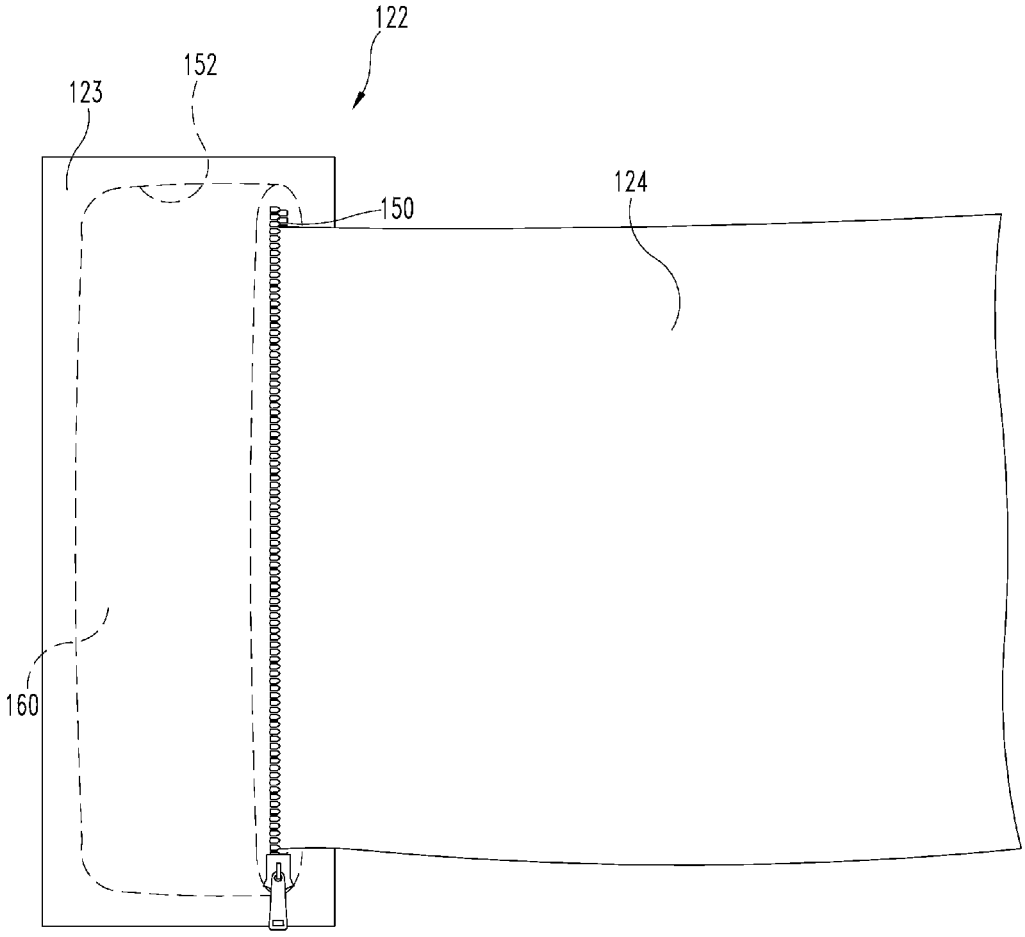

FIG. 6 is front view of an alternative embodiment of a portion of a garment according to the present disclosure.

DESCRIPTION OF THE ILLUSTRATED EMBODIMENTS

For the purposes of promoting an understanding of the principles of the disclosure, reference will now be made to certain embodiments and specific language will be used to describe the same. It will nevertheless be understood that no limitation of the scope of this disclosure and the claims is thereby intended, such alterations, further modifications and further applications of the principles described herein being contemplated as would normally occur to one skilled in the art to which this disclosure relates. In several figures, where there are the same or similar elements, those elements are designated with the same or similar reference numerals.

Referring now generally to FIGS. 1-4, there is shown a garment 20 according to one embodiment of this disclosure. Garment 20 is styled as a vest in this embodiment, and in other embodiments garment 20 may be other types of garments, such as a jacket (e.g. FIG. 5), shirt or trousers. One or more pockets 22 are attached to or built into garment 20, and a flag 24 is attached to one or more of pockets 22, as described further below. Garment 20 provides a motorcyclist or other open-vehicle rider with an opportunity to fly one or more flags 24 when riding, and to enclose such flag(s) 24 to protect them during inclement weather, when garment 20 is in storage, or at other times when he or she does not wish to fly or expose them.

The vest embodiment of garment 20 shown in FIG. 1 includes a front portion 30 with left and right parts or sides 32 and 34 (as viewed by the wearer) and a rear portion 36. Garment 20 in this embodiment may be made of a single piece of leather, cloth or fabric, or other material, so that front and rear portions 30, 36 are monolithic and have no seams, or can be made of two or more separate pieces assembled together. For example, a left part 32, a right part 34, and a rear portion 36 may be sewn or otherwise attached, as with a first side seam between left part 32 and rear portion 36 and a second side seam between right part 24 and rear portion 26. Fasteners 38, such as snaps, buttons, hooks-and-eyes, or similar items for linking or fastening clothing parts may be placed on one or both of parts 32 and 34, so that garment 20 may be held closed when worn during a motorcycle ride or if the wearer desires it at other times. Parts 32 and 34 with rear portion 36 define respective areas for accommodating the user's arms, which in this embodiment are arm holes 40 and 42, and a neck opening 44. The particular embodiment of garment 20 shown in FIG. 1 also includes a pair of standard pockets 46. Each pocket 46 may be a patch pocket, a tailored or bag pocket, or another type of pocket.

The embodiment illustrated in FIG. 1 has two pockets 22, which are identical in this embodiment, and so for brevity only one will be described. It will be understood that other embodiments may have a single pocket 22, or may have more than two pockets 22. Pocket 22 in this embodiment is a tailored or bag-type pocket, having an opening 50 through part 32 of garment 20 that opens into a bag 52 of additional material attached to the inside of part 32. Opening 50 in this embodiment is substantially rectangular, with a very small dimension in a side-to-side direction (e.g. approximately horizontal in FIG. 1 and when garment 20 is being worn) and a much larger dimension in a top-to-bottom direction (e.g. approximately vertical in FIG. 1 and when garment 20 is being worn). Opening 50 may include a closure, such as zipper 54, that can be used to selectively open or close opening 50 to a desired degree. Bag 52 is fashioned from a piece of material separate from the rest of part 32, and in particular embodiments is of a different material from that of part 32. For example, if part 32 is of leather, bag 52 may be of relatively thin cloth, nylon or other synthetic material, or other materials commonly used to construct pockets. If a lining is present within garment 20, bag 52 may be between the lining and part 32.

Bag 52 has a mouth 56 that is at least slightly larger than opening 50, with the edge 58 surrounding mouth 56 sewn or otherwise affixed to the inside of part 32 around opening 50. When so attached, bag 52 also defines an internal space 60 within the fabric of bag 52 and within opening 50. Space 60 is large enough to contain the entirety of flag 24, preferably in a rolled, folded or otherwise neat stored condition. Thus, in the illustrated embodiment bag 52 has a generally rectangular shape with a length dimension L that is at least slightly longer than opening 50, and a depth dimension D that is deep enough to accommodate flag 24. For example, depth D may be at least slightly larger than one-third of a dimension of flag 24, so that flag 24 can be folded in thirds and comfortably stored in pocket 22. It will be understood that other dimensions for depth D may be provided that are suited to other sizes of folds of flag 24, or that are not suited to particular folds but simply will accommodate storage of flag 24. Depth D of bag 52 may be quite shallow in some embodiments, e.g. one to two inches, and will accommodate a rolled flag 24.

The illustrated embodiment shows openings 50 of pockets 22 along respective side seams or otherwise generally at respective areas where parts 32, 34 join rear portion 36, essentially directly beneath the respective arms of a user that extend through arm holes 40, 42. Such an embodiment ensures that the user's arms will be above and free of flags 24 when flags 24 extend from openings 50. The waving of flags 24 thus do not interfere with movement of the user's arms or hands as he or she operates the vehicle. It is contemplated that one or more pockets 22 and their openings 50 could be positioned further back on garment 20, e.g. in portion 36, or fully behind the user. It has been discovered that in some conditions such placement does not always provide optimum extension of flag(s) 24, as air flow directly behind the user of a motorcycle or other open vehicle may be low or inconsistent.

Flag 24 is a piece of material attached within pocket 22 and capable of extending outside of pocket 22 when the user desires. In the illustrated embodiment, flag 24 is rectangular (e.g. with constant length and width dimensions) and made of a cloth material, although it will be understood that other shapes (e.g. triangular) and other materials (e.g. plastics, synthetic fabrics or the like) can be used in flag 24. A base 64 of flag 24 has a length that is smaller than the length of opening 50 and mouth 56 of bag 52 of pocket 24 in particular embodiments, so that neither bag 52 nor opening 50 bind flag 24 or force it to partially fold or curl over at times when flag 24 extends from pocket 22. Base 64 is fixed within pocket 22 (i.e. inside space 60 of bag 52). In the illustrated embodiment, the entirety of one side of base 64 is fixed permanently, as by sewing, adhesive attachment or similar processes, to one side or part of bag 52 and/or through bag 52 to part 32 of garment 20. Consequently, base 64 may be reinforced (e.g. a double or larger thickness of material, or of a stronger or sturdier material) compared to the rest of flag 24 in some embodiments, so that base 64 can be firmly held within pocket 22.

In other embodiments, base 64 may be fixed within pocket 22 in a temporary or easily replaceable manner. Snaps, buttons, hook-and-loop-fastener strips, zipper, or similar devices may be applied or placed on base 64 and within pocket 22, so that flag 24 may be easily fixed within pocket 22 and removed as desired. In such an embodiment, one flag 24 may be easily removed from pocket 22 and replaced with another. Accordingly, the user can replace a worn flag 24 with an identical or similar replacement, or change a flag 24 having one particular design (e.g. a country flag) to another having a different particular design (e.g. a team flag).

A free or unattached portion 66 of flag 24 is beyond base 64 and is not fixed to pocket 22 or part 32 of garment 20. Accordingly, with base 64 attached by one side to one part of garment 20, the remainder of flag 24 can have a stored condition and an extended condition. In the stored condition, flag 24 is placed within space 60 of pocket 22. Flag 24 may be rolled, folded or otherwise manipulated to limit or prevent unsightly wrinkling, if desired, prior to insertion of the unattached portion 66 of flag 24 into space 60. By attaching base 64 only on one side to one part of pocket 22 and/or part 32, space 60 is not blocked or closed by base 64, and the free portion 66 of flag 24 can be inserted into pocket 22 past or adjacent to base 64. In the extended condition, most or substantially all of the unattached portion 66 of flag 24 is outside of opening 50 of pocket 22. The only portion of flag 24 inside of opening 50 (i.e. within space 60 of pocket 22) is attached base 64 and any unattached portion between attached base 64 and opening 50.

Flag 24 may have any of a variety of insignia, messages, logos, or other graphic design or information on the unattached portion, as may be culturally available and/or to the taste of the user. For example, the design of a country's flag (such as the United States or Canada), other recognized flag designs (such as the well-known POW/MIA design), the logo of a university or team, an advertising message, or other design may be printed or otherwise affixed to flag 24.

Accordingly, when the user wishes to ride and display flags 24, he or she opens pocket 22, as by unzipping zipper 54 or otherwise unfastening if fasteners are provide with opening 50. The user reaches into space 60 in pocket 22 and pulls out flag 24, until the attachment of base 64 to garment 20 resists further pulling. Flag 24 is then in the extended condition noted above (e.g. FIG. 3). As the user rides, air flow around the motorcycle and around the user causes flag 24 to wave, extending outward substantially linearly from opening 50 behind the user. With opening 50 positioned as noted above, e.g. directly beneath the user's arm, the extended and waving flag 24 does not touch the user's arm (which is extended forward to the handlebars of the motorcycle), and cannot be in the way of the user's operation of the motorcycle. The placement on garment 20 also means that flags 24 will extend and wave above the waist of the rider, and thus above the seat of the motorcycle, away from hot or moving parts of the motorcycle. When the user is finished riding, or otherwise wishes to store or protect flag(s) 24, he or she collects flag 24 and may roll, fold or otherwise arrange it, and inserts it through opening 50 into space 60 in pocket 22 (e.g. FIG. 4). Fasteners on pocket 22 (e.g. zipper 54), if provided, can be used to secure pocket 22 and flag 24 inside it.

Garment 20 described above is in the form of a vest. It will also be understood that this disclosure includes other types of garments. For instance, shown in FIG. 5 is an example of a garment 20 in the form of a jacket. The jacket embodiment is much the same as the vest embodiment of garment 20 discussed previously, with the principal difference being the presence of sleeves 100 and other features (such as a collar) not usually included with vests. The jacket includes at least one pocket 22 (two in the embodiment of FIG. 5) arranged and located as described above. A flag 24 is attached within pocket 22 as described above, and can be stored or extended as previously noted. Similarly, garment 20 may be a shirt originally fitted or retrofitted substantially as described with respect to the jacket and vest embodiments of garment 20. It is also contemplated that garment 20 may be formed as a pair of trousers, having one or more pockets 22 and associated flag(s) 24 in or on the legs of the trousers. As described above with respect to the vest and jacket embodiments of garment 20, the user can extend or store flags 24 in their respective pockets 22, allowing them to wave during riding a motorcycle. In this embodiment, the size of flags 24 may be reduced so as to ensure that the free ends of flags 24 do not approach or interfere with the engine or moving parts of the motorcycle.

Garment 20 can be initially made as described above, or an existing garment can be retrofitted into garment 20. In an example of the former, a vest or jacket garment 20 is originally built with one or more pocket(s) 22. Parts 32 and 34 are created with openings 50, and bags 52 are attached prior to lining garment 20. Flags 24 are attached by their bases 64 within bags 52, to be fixed to bags 52 and/or part 32 or part 34, as noted above. An example of retrofitting can include taking an existing vest or jacket, providing it with pocket(s) 22 or replacing smaller or otherwise unsuitable pockets with pockets 22 (if necessary), and adding flags 24. If flags 24 are to be attached permanently, then base portions 64 of flags 24 can be sewed or glued within pockets 22. In other embodiments, snaps, hook-and-loop-fastener strip, zipper or other fastener (s) can be applied inside pockets 22. Flags 24 with complementary fastener(s) are then provided or attached to the fastener(s) in pockets 22.

In the above discussion, pockets 22 have been described as initially built into garment 20, or existing pockets have been retrofitted with needed structure, such as larger bags or openings, or fasteners. It is also contemplated that a separate pocket with a flag may be created, and later temporarily or permanently attached to a garment. Accordingly, referring to FIG. 6, an embodiment of a stand-alone pocket 122 is shown, which can be attached or fitted to a garment (e.g. vest, jacket, shirt, trousers) during the building of the garment or in retrofitting an existing garment. Pocket 122 includes a base 123 of material, along with an opening 150 through base 123 and a bag 152 (defining an interior space 160) attached to base 123 to surround opening 150, substantially as described above with respect to opening 50 and bag 52. It will also be understood that bag 152 may be left out if base 123 is attached to a garment as a patch pocket, with space 160 enclosed by base 123 and a portion of the garment. A flag 124 is attached within pocket 122, as by any of the ways described above. The material used for base 123 may be the same as that of a jacket, vest, shirt, trousers or other garment to which pocket 122 is to be attached. For example, if pocket 122 is to be attached to a leather jacket, the base 123 of pocket 122 may be generally of leather, or of a type, quality and color that matches or approximates the leather in the underlying jacket. Alternatively, the material of base 123 may be significantly different from that of the underlying garment, as the user may desire. Pocket 122 is attached to a garment, e.g. a side part 32 of a vest or jacket positioned as indicated in the drawings, by sewing, adhesive, or other attaching method. With pocket 122 attached to garment 20, the user can store and extend flag 124 when using garment 20 as noted above.

The above discussion has used the term "flag" to refer to item 24 that extends from garment 20 and waves or flaps in the air flow around a rider. "Flag" as used herein should be understood to refer to any type of such an item, including banners, pennants and other such items that extend in air flow. Also, in several parts of the above discussion the example of a motorcycle and its rider were used. It is to be understood that the structures and products disclosed herein can be used not only by users of motorcycles but also by users of other types of open vehicles, such as bicycles and mopeds. It will be understood that pockets 22 may be formed as patch pockets or other types of pockets in addition to the types described above.

While the disclosure has been illustrated and described in detail in the drawings and foregoing description, the same is to be considered as illustrative and not restrictive in character, it being understood that only certain specific embodiments have been shown and that all changes and modifications that come within the spirit of the disclosure are desired to be protected. It is to be understood that features described with respect to one embodiment or aspect of the disclosure can be used with other embodiments or aspects of the disclosure.

What is claimed is:

1. A garment for the human torso, comprising:

at least one pocket having an opening and defining an internal space within said garment, said pocket being a tailored pocket with said opening through said garment that opens into a bag of additional material attached to the inside of said garment, and a flag having a base and a free portion extending from said base, said base being attached to said pocket within said internal space so that all of said base is within said internal space and so that at least part of said free portion can extend outside of said opening, and wherein said base has a length that is less than a length of said opening, and wherein said flag has a first relative position in which the entirety of said flag resides in said internal space, and a second relative position in which at least part of said free portion extends outside of said internal space, and wherein in said second relative position said flag can wave with air passing by while being fixed to said pocket.

2. The garment of claim 1, wherein said garment is one of a jacket, vest and shirt.

3. The garment of claim 1, wherein said garment has an area that allows user's arms to extend through said garment, and said at least one pocket is below said area.

4. The garment of claim 1, wherein said garment has an area that allows user's arms to extend through said garment, and said at least one pocket is not anterior of said area.

5. The garment of claim 1, wherein said garment has a right side and a left side, and said garment has a first said pocket on said right side and a second said pocket on said left side, each of said first and second pockets having a respective flag attached thereto.

6. The garment of claim 1, wherein said flag is attached to said pocket by permanent attachment.

7. The garment of claim 6, wherein said permanent attachment includes at least one of sewing and adhesive attachment.

8. The garment of claim 1, wherein said flag is attached to said pocket by releasable attachment.

9. The garment of claim 8, wherein said releasable attachment includes at least one fastener from the group consisting of snaps, zipper, hook-and-loop fastener, and buttons.

10. The garment of claim 1, wherein said pocket is built into said garment.

11. The garment of claim 1, wherein said pocket is initially separate from said garment and is attached to an exterior portion of said garment.

12. A garment, comprising:

a portion for covering a user's torso and having right and left areas for allowing the user's arms to pass through, said areas having at least one of openings or sleeves;

first and second pockets, said first pocket positioned below and not anterior of said right area and said second pocket positioned below and not anterior of said left area, so that said pockets are away from the user's arms when the arms are extended in front of the user, at least one of said pockets being a tailored pocket with an opening through said garment that opens into a bag of additional material attached to the inside of said garment;

a first flag attached within said first pocket, said first flag including a base entirely within said first pocket and a free portion, wherein said free portion of said first flag is adapted to be able to be contained within said first pocket in a first condition and to be extended outside of said first pocket in a second condition;

a second flag attached within said second pocket, said second flag including a base entirely within said second pocket and a free portion, wherein said free portion of said second flag is adapted to be able to be contained within said second pocket in a first condition and to be extended outside of said second pocket in a second condition;

wherein when one or both of said flags are in said second condition and the user is riding an open vehicle, said flag(s) in said second condition wave behind the user.

13. The garment of claim 12, wherein said base of at least one of said flags is attached to its respective said pocket by a permanent attachment.

14. The garment of claim 12, wherein said base of at least one of said flags is attached to its respective said pocket by a temporary attachment.

15. The garment of claim 14, further comprising at least one replacement flag, wherein the temporary attachment of said base of said at least one of said first and second flags can be discontinued, said at least one of said first and second flags can be removed from its respective pocket, and said at least one replacement flag can be attached to said respective pocket by a temporary attachment.

16. The garment of claim 12, wherein said garment is one of a jacket, vest and shirt.

17. The garment of claim 16, wherein said garment is suitable for use in riding a motorcycle.

* * * * *